United States Patent [19]

Teysseyre et al.

[11] 4,191,510

[45] Mar. 4, 1980

[54] AXIAL FLOW COMPRESSOR ROTOR DRUM

[75] Inventors: Pierre M. Teysseyre, Villejuif; Claude P. Baudier, Orsay, both of France

[73] Assignee: Societe Nationale d'Etude et de Construction de Moteurs d'Aviation (S.N.E.C.M.A.), Paris, France

[21] Appl. No.: 829,214

[22] Filed: Aug. 31, 1977

[30] Foreign Application Priority Data

Apr. 28, 1977 [FR] France ..... 77 13475

[51] Int. Cl.[2] ..... F01D 5/06

[52] U.S. Cl. ..... 416/230; 416/218; 416/241 A; 416/244 A

[58] Field of Search ..... 416/230, 218, 241 A, 416/244 A

[56] References Cited

U.S. PATENT DOCUMENTS

| | | | |
|---|---|---|---|
| 3,403,844 | 10/1968 | Stoffer | 416/230 |
| 3,501,090 | 3/1970 | Stoffer et al. | 416/218 X |
| 3,502,529 | 3/1970 | Borgnolo et al. | 156/172 |
| 3,505,717 | 4/1970 | Palfreyman | 29/156.8 |
| 3,515,501 | 6/1970 | Palfreyman et al. | 416/193 |
| 3,532,438 | 10/1970 | Palfreyman et al. | 416/213 |
| 3,532,439 | 10/1970 | Palfreyman et al. | 416/230 X |
| 3,549,444 | 12/1970 | Katz | 156/175 |
| 3,616,508 | 11/1971 | Wallett | 29/156.8 R |
| 3,625,634 | 12/1971 | Stedfeld | 416/198 |
| 3,632,460 | 1/1972 | Palfreyman et al. | 156/175 |
| 3,675,294 | 7/1972 | Palfreyman et al. | 29/156.8 R |
| 3,813,185 | 5/1974 | Bouiller et al. | 416/198 |
| 3,904,316 | 9/1975 | Clingman et al. | 416/218 |
| 3,966,523 | 6/1976 | Jakobsen et al. | 156/169 |

FOREIGN PATENT DOCUMENTS

| | | | |
|---|---|---|---|
| 2347858 | 11/1977 | France | 416/230 |

*Primary Examiner*—Everette A. Powell, Jr.

*Attorney, Agent, or Firm*—Louis E. Marn; Elliot M. Olstein

[57] ABSTRACT

A rotor driven for an axial flow gas turbine engine compressor is formed as a composite structure of inner and outer skins with a core therebetween and a set of tensile reinforcing rings each located in a respective groove of a corrugated outer surface of the drum. In the completed drum the drum body is preferably under compressive prestress while the reinforcing rings are under tensile prestress.

8 Claims, 15 Drawing Figures

AXIAL FLOW COMPRESSOR ROTOR DRUM

The present invention relates to a drum for a compressor rotor, and to a process for its manufacture.

The object of the invention is to replace, in a gas turbine engine compressor, the series of discs which carries the compressor blades, by a cylindrical or conical thick-walled drum in which are provided seats intended to receive the rotor blades of the compressor.

According to one aspect of the present invention we provide a drum for a compressor rotor, produced from a composite material and having recesses intended to receive the rotor blades, comprising an external and an internal skin, between which is located a core, the said external skin having corrugations which define grooves in which tensile reinforcing rings are located.

Preferably, the seats intended to receive the rotor blades of the compressor consist of orifices which allow the blades to be put into place from the inside of the drum, and are produced in zones corresponding to the ridges of the corrugations of the said external skin, said corrugations having oblique faces. This arrangement exhibits better utilisation of the composite materials because of a more rational arrangement of the fibres of the drum, taking into account the stresses to be transmitted.

Given that the largest stress is due to the centrifugal force exerted by the blades, the external skin is principally subjected to tensile stresses, whilst the internal skin is prestressed to be subjected to compressive stresses which tend instead to draw in the drum.

Furthermore, the oblique parts of the corrugations of the external skin make it possible to resolve the shear stress exerted on the external skin under the action of centrifugal force into, respectively, a tensile stress located in the plane of the fibres forming these oblique parts and a compressive stress exerted on the core and the internal skin.

This arrangement furthermore allows simple machining of the seats of the blades, the use of a varying number of blades per compressor stage, and the interchange of blades during repair.

According to a second aspect of the invention we provide a process for the manufacture of the drum of the first aspect, comprising shaping a moulding on the inside of a cylindrical mould so as to exhibit, on its external face, grooves intended to receive binding rings, the said moulding having an internal corrugated face; forming on said internal face, in succession, the external skin, the core and the internal skin; releasing the assembly thus formed, from the mould and mounting it on a winding mandrel for placing the reinforcing rings in position.

According to a third aspect of the invention we provide a process for the manufacture of a drum for a compressor rotor from a composite material and having recesses intended to receive the rotor blades, the said drum consisting of an external and an internal skin, between which is located a core, the said external skin having corrugations which define grooves in which are located tensile reinforcing rings, wherein the positioning and the polymerisation of the tensile reinforcing rings are carried out whilst the drum is at the same time subjected to a compressive prestress.

In order that the present invention may more readily be understood the following description is given of several embodiments, merely by way of example, with reference to the accompanying drawings, in which.

Figure 1:
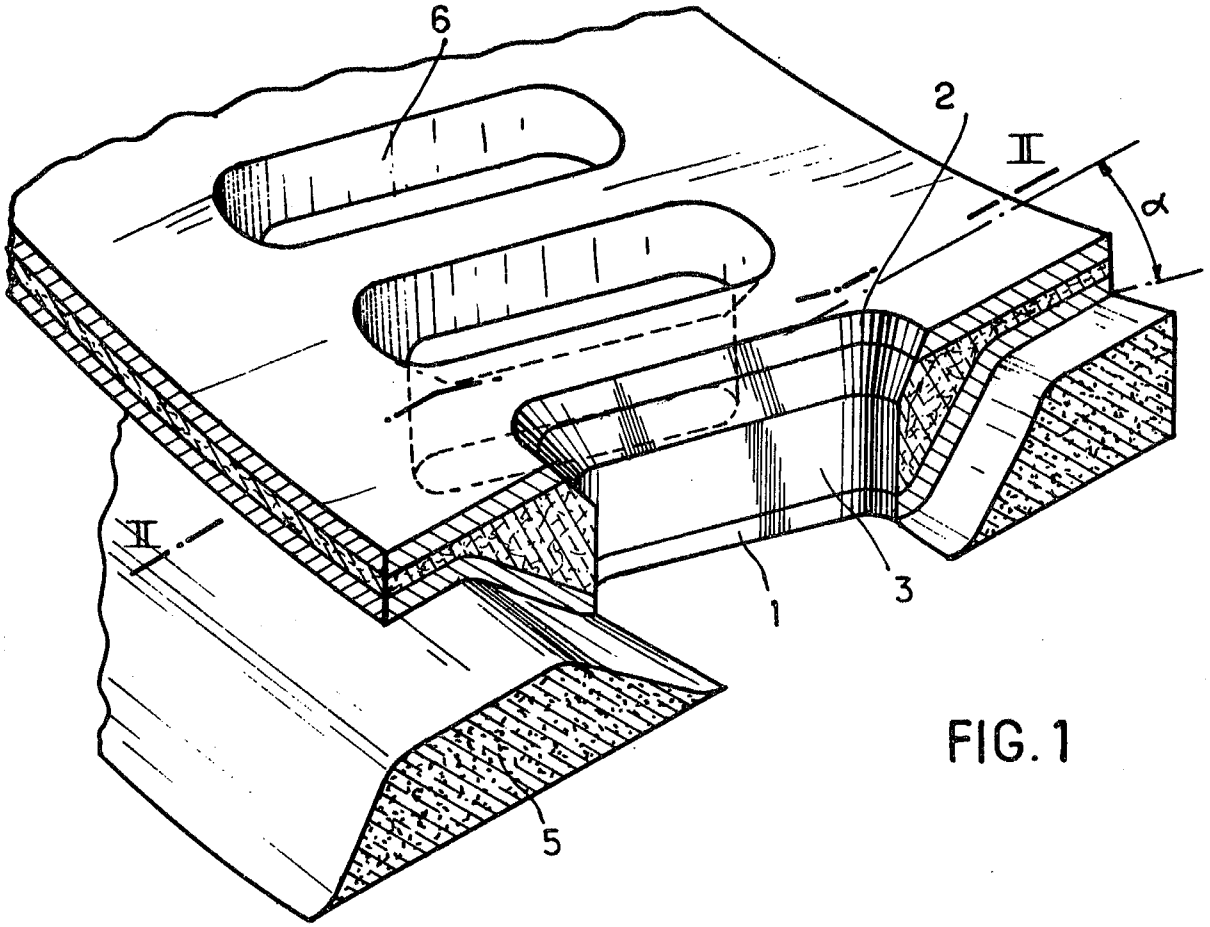
FIG. 1 is a partial view, in perspective of a compressor rotor drum according to the invention.
Figure 2:
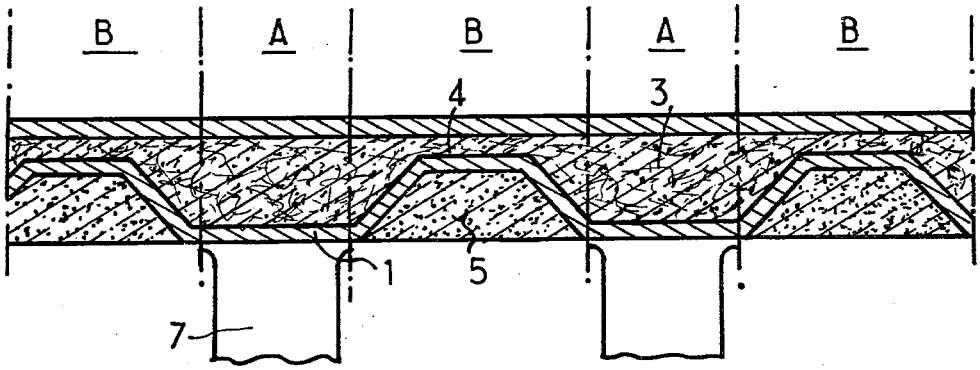
FIG. 2 is a cross-sectional view of the drum, taken along line II—II of FIG. 1.
Figure 3:
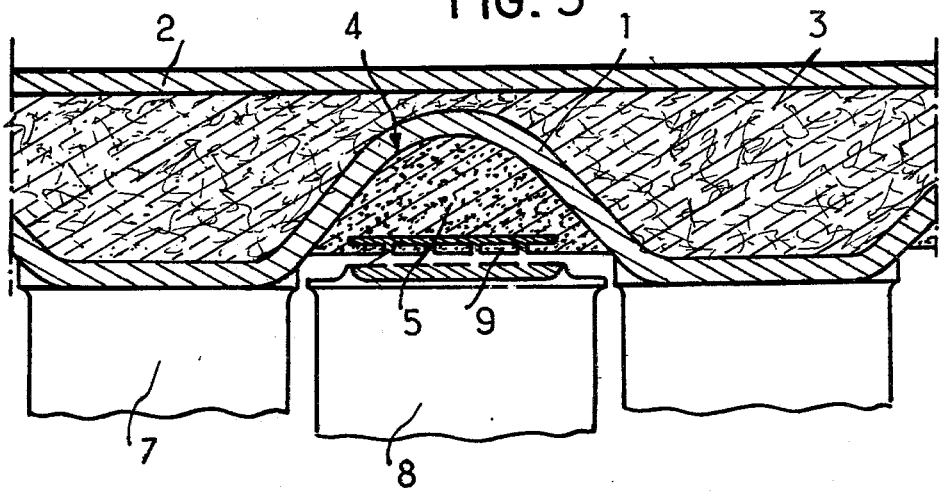
FIG. 3 is the same view as in FIG. 2, also showing the stator blades.

FIGS. 1, 2 and 3 show a drum of a rotor for a gas turbine engine compressor, which drum consists of an external skin 1 and an internal skin 2 between which is located a core 3. The external skin 1 has corrugations which define grooves 4 in which binding rings 5 are located.

Cavities 6 provided in the wall of the drum are each intended to receive the stem of a rotor blade 7, which blade is to be oriented at an angle of $+\alpha$ relative to a generatrix of the drum.

The stator blades 8 are located opposite the binding rings 5 which carry tabs 9 of the labyrinth seal against which the stator blades come into contact.

As shown in FIG. 2, the drum, of cylindrical or slightly conical cross-section, consists alternatively of zones marked A intended to hold the rotor blade stages of the compressor and zones B intended to withstand the stresses induced in the blades by centrifugal forces.

The structure shown in FIGS. 1, 2 and 3 is merely schematically depicted. Supplementary filling-in components, in addition to the four basic elements of the structure described above, will be mentioned in the description which follows. The most important part consists of a moulding which is present on the outside of the drum and which possesses grooves into which the resin impregnated reinforcing fibre rings 5 are wound.

Figure 4:
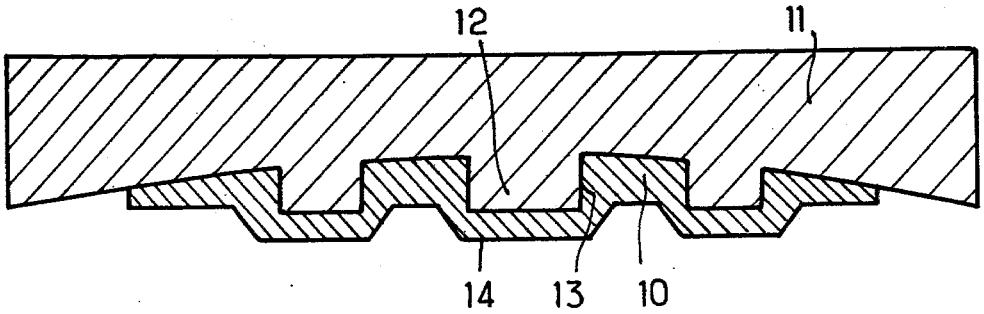
FIG. 4 is a view in cross-section of a first embodiment of a moulding.

In FIG. 4 is shown a first embodiment of a moulding 10 in a mould 11 of cylindrical external shape, which mould can be dismantled and in particular consists of two half-shells. The internal shape of the mould reproduces in relief, by means of ribs 12, grooves 13 (FIG. 7) intended to receive the reinforcing rings 5.

The moulding 10 is produced by assembling components which have beforehand been moulded in a press and consist of a material produced from a preliminary mixture of glass fibres from 6 to 15 mm long impregnated with an organic matrix (known by the American name of premix or compound).

As can be seen in FIG. 4, the internal face 14 of the moulding reproduces, in hollows, the relief of the corrugated external skin 1.

These components are assembly by gluing, ensure that none of the gluing planes passes through the future locations of the blades.

To facilitate the gluing operation, the various components of the moulding 10 are introduced into the mould 11.

Figure 5:
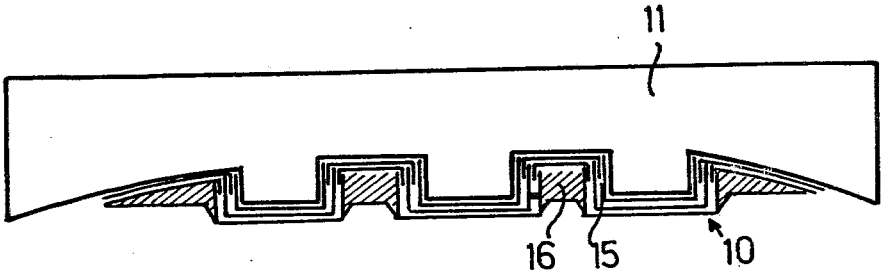
FIG. 5 is a view in cross-section of another embodiment of a moulding.

FIG. 5 shows a different embodiment of the moulding 10 made of laminated glass fibre fabric. In this case, impregnated layers of glass fibre fabric 15 are applied to the internal face of the mould 11 successively and in accordance with the overlap shown in FIG. 5. This lining of the mould, the lining being of substantially constant thickness, is moulded in an autoclave.

In the next stage, and for the purpose of obtaining a shape whose internal face reproduces as in hollows the relief of the corrugated external skin 1, the filling of the hollow parts 16 is completed with a resin filled with hollow glass beads or strips of glass fabric or other impregnated high modulus fibres.

After polymerising the moulding 10 in an autoclave, the desired profile of the corrugated external skin is machined.

The next operation is the application of the external skin 1 (FIG. 6) to the moulding 10. Layers consisting of webs or fabrics of carbon fibre, the majority of the fibres being oriented at an angle $+\alpha$ (FIG. 1), that is to say parallel to the root chord of the rotor blades, are applied to the internal face of the moulding 10, in order to produce pseudogirders bearing, on either side, on reinforcing rings.

Figure 6:
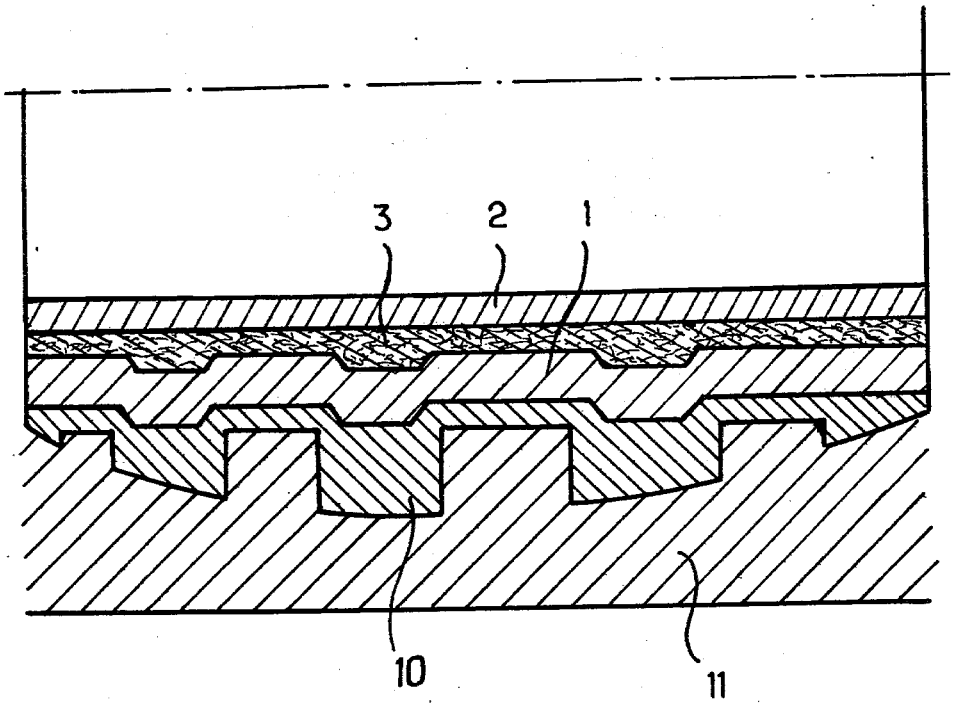
FIG. 6 is a cross-sectional view of the various components of the drum mounted on the moulding and on the mould.

These layers of oriented fibres are either fabrics of unidirectional fibres, or webs of parallel fibres, and are impregnated in both cases. It should be noted that the orientation $+\alpha$ of the fibres corresponds to a preferred orientation but that certain "layers" can be oriented at a different angle. These layers of fibres are used to line the internal face of the moulding 10 (FIG. 6).

The assembly consisting of the mould 11, the moulding 10 and the external skin 1 is placed in an autoclave essentially in order to polymerise the external skin 1.

The next operation is the production of the core 3, which is applied (FIG. 6) to the inner face of the external skin 1.

In a first embodiment, a material produced from a premix of glass fibres from 6 to 15 mm long, impregnated with an organic matrix, is used. This material is beforehand moulded in a press, component by component, to have the section marked 3 in FIG. 1. These components are then assembled and joined by gluing onto the external skin. This gluing operation is carried out simultaneously with the operation of polymerising the external skin 1 in an autoclave.

In another embodiment, the core is obtained by laminating webs of glass fabric or of an impregnated mixed glass-carbon fabric, and is pressed and polymerised in an autoclave. The shape obtained is subsequently reduced by machining so as to give a substantially cylindrical internal surface.

In a fresh operation, the internal skin 2 (FIG. 6) is applied to the internal face of the core 3. This operation is identical to that which has been used for positioning the external skin 1 on the moulding (a moulding operation in an autoclave).

Better rigidity, in respect of both compressive stresses (a tendency to draw in) and other stresses, especially torsional stresses due to the drive torque of the motor and stresses due to flexing of blades in the acceleration and deceleration phases is achieved by orienting the layers of fibres along two angles $+\alpha$ and $-\alpha$ (see FIG. 1).

Thereafter, the internal face of the drum is machined to an accurate surface.

Figure 7:
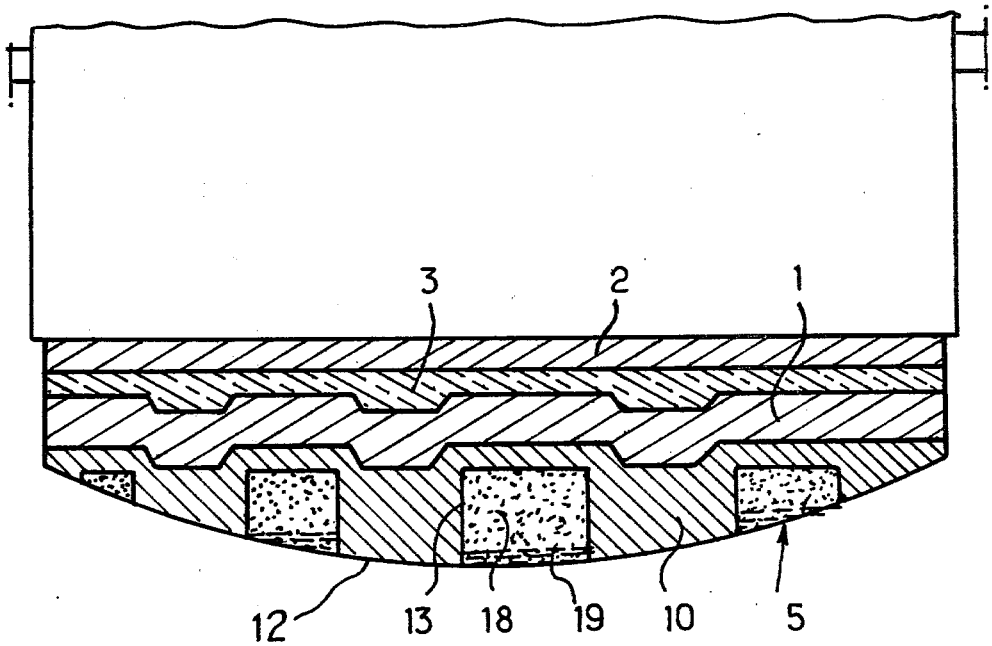
FIG. 7 is a cross-sectional view of the drum mounted on a mandrel for positioning the tensile reinforcing rings.
Figure 8:
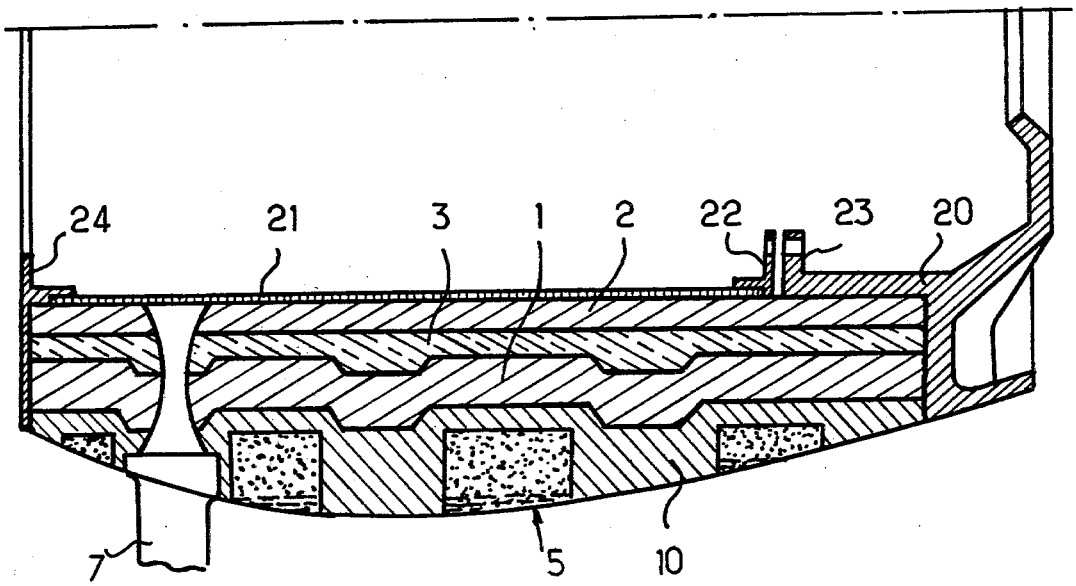
FIG. 8 is a cross-section of the finished drum.

After releasing the drum from the mould, the drum is mounted on an internal winding mandrel 17 as shown in FIG. 7 so as to wind the reinforcing rings 5.

After having, if necessary, finished the profile of the grooves 13 by machining, boron fibres 18 impregnated with an organic resin are wound into the grooves 13 and polymerisation of the resin is carried out to form tensile reinforcing rings or hoops (5 in FIG. 2).

These known fibres consist of generally metallic threads coated with a deposit of boron, boron nitride, or boron carbide, or boron protected by a thin deposit of silicon carbide.

The filling of the grooves is finished by winding resin-impregnated glass fibres 19 or, in another embodiment, by placing the tabs 9 shown in FIG. 3 in position.

After polymerisation, the glass fibres winding constitutes, in a sense, an abradable material against which the stator blades can rub without suffering damage.

After removal from the mandrel 17, the cavities 6 are machined; these cavities are intended to receive the rotor blades 7 which are introduced from the inside of the drum at right angles to its surface.

Thereafter, a cone of titanium alloy, 20 which constitutes a connection between the drum and a drive shaft (not shown), is fitted into, and glued onto, the front face of the drum.

When the blades are in place, a locking skirt 21 is introduced into the drum; this skirt possesses, at the front, a titanium flange 22 which is secured onto the part 23 of the cone 20.

At the back of the skirt 21 is located a titanium flange 24 intended for the attachment of balancing weights.

The skirt 21 can simply consist of a cylinder wound of glass fibres. The function of this skirt is principally to hold the blades in their cavities and it does not participate structurally in the mechanical strength of the drum.

FIGS. 9 to 15 illustrate an improvement in the process of manufacture of the drum, in which the positioning and polymerisation of the tensile reinforcing rings are carried out whilst the drum is subjected simultaneously to a compressive prestress.

The presence of this compressive prestress in the drum makes it possible to reduce tensile stresses generated in the drum during rotation, thereby increasing the speed of rotation at which cracks appear, and to reduce the penetration of moisture and/or oxygen, which are detrimental to the materials of which the rotor is formed.

Figure 9:
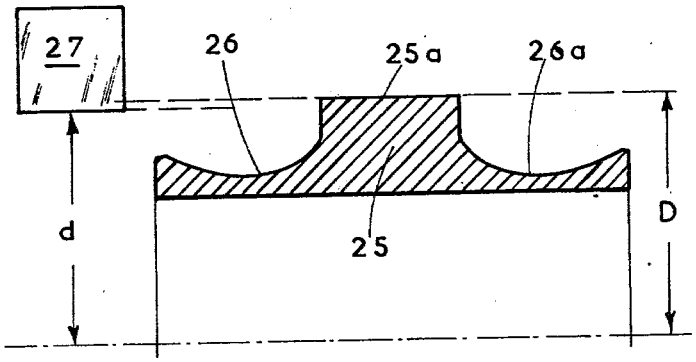
FIG. 9 is a longitudinal sectional view of the drum and of the compression ring before the latter is positioned of the drum.
Figure 10:
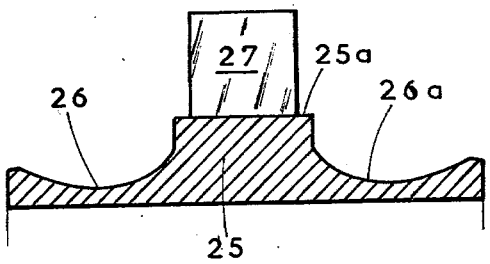
FIG. 10 is the same view of the drum when the compression ring has been mounted in place.

FIG. 9 and 10 show the drum 25 which has been mentioned above and which consists of an external and an internal skin, between which is located a core, the said external skin having corrugations 25a which define grooves 26, 26a intended to receive boron fibre binding rings.

The drum 25 is subjected to a compressive prestressing operation by means of a compression ring 27 consisting of an aluminum-based alloy.

Such a ring 27, the internal diameter d of which is less than the diameter D of the drum, is shrunk over each zone 25a corresponding to a corrugation ridge of the external skin of the drum. Thus when the ring 27 is at ambient temperature, the drum is thus in a condition of compressive prestress as shown in FIG. 10.

Figure 11:
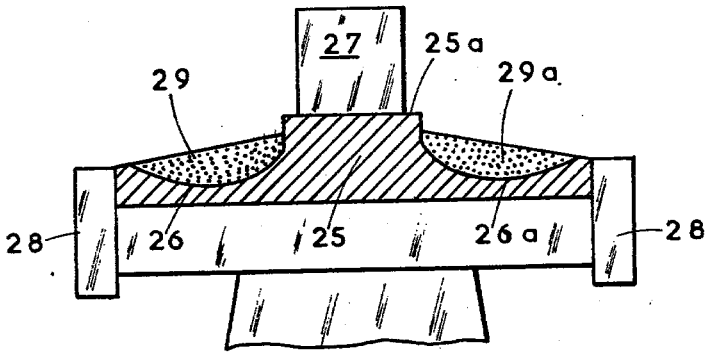
FIG. 11 is a cross-sectional view of the drum during the stage of winding the fibres of the tensile reinforcing rings.

Thereafter the drum 25, equipped with the compression ring 27, is mounted on a mandrel 28 which is driven rotationally, in order to permit winding of the boron fibres, which constitute the reinforcing rings 29, 29a, into the grooves 26, 26a (FIG. 11).

Around the first ring 27 is engaged, without play, a second ring 30 (FIG. 12) of Invar metal, that is to say an alloy of iron with 38% of nickel. This second ring 30 will also be referred to as a deformation locking ring in the discussion which follows.

The ratio of the cross-sections of the rings 27 and 30 is so calculated that the thermal expansion of the assembly of the two rings, in the temperature range within which the polymerisation of the resin with which the fibres of the binding rings 29, 29a occurs, is substantially identical to that of the fibres which constitute the reinforcing rings.

The coefficients of thermal expansion of the alloys which respectively constitute the rings 27 and 30 are in fact so chosen that the coefficient of expansion of the fibres is between the coefficients of these rings. By way of example, and solely for the purpose of giving an order of magnitude, the coefficients of heat expansion of the fibres of the ring 27 and the ring 30 can respectively be $6.10^{-6}$ per °C., $22.10^{-6}$ per °C. and $3.5.10^{-6}$ per °C.

The polymerisation of the resin with which the fibres of the binding rings are impregnated can now be carried out in the presence of the rings 27 and 30.

When this polymerisation operation is finished, the rings 27 and 30 are removed.

Figure 13:
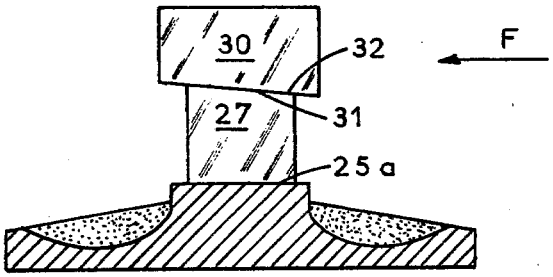
FIG. 13 is a cross-sectional view of a different embodiment of the drum, during the polymerisation operation.
Figure 15:
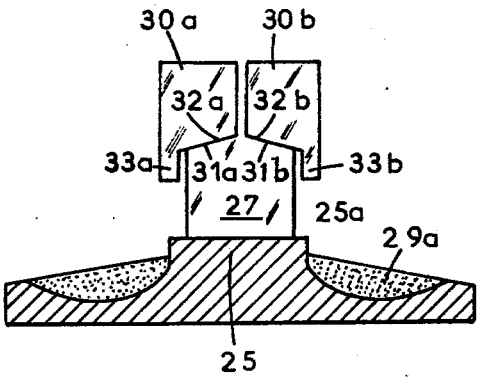
FIG. 15 is a view in cross-section showing a different embodiment of the drum with a single corrugation zone, during the polymerisation operation.
Figure 14:
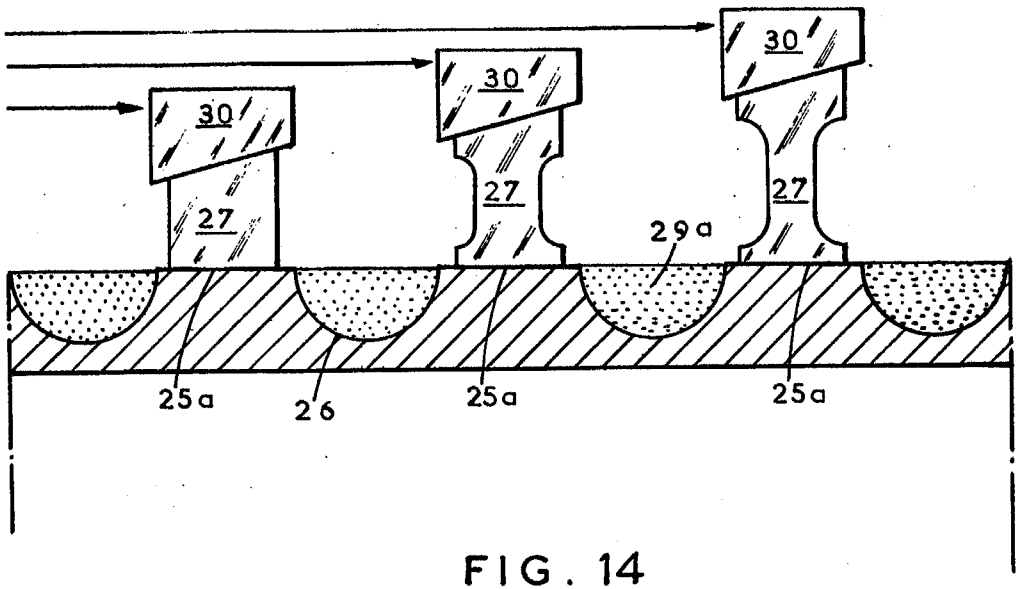
FIG. 14 is a similar view of a drum showing several corrugations.

In FIGS. 13, 14 and 15 are shown, by way of alternative embodiments, pairs of rings, namely compression rings and deformation locking rings respectively, in which at least one conical contact surface makes it possible to facilitate positioning without play, and removing, the deformation locking ring.

Figure 12:
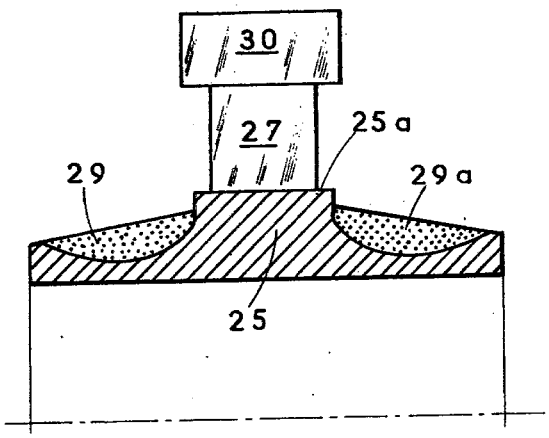
FIG. 12 is a cross-section through the drum during the operation of polymerising the resin with which the fibres of the tensile reinforcing rings are impregnated.

In FIG. 13, which is analogous to FIG. 12, the ring 27 and 30 respectively have conical surfaces 31 and 32 which cooperate so as to facilitate the engagement, in the direction of the arrow F, of the ring 30 of Invar metal on the compression ring 27.

In FIG. 14, which shows a view in cross-section of a drum comprising several corrugation zones of the external skin and several reinforcing rings, are shown pairs of rings 27 and 30 possessing, like those of FIG. 13, cooperating conical surfaces. The increasingly distorted shapes of the profiles of the rings 27, in the direction of increasing diameters, are so that the ratio of the cross-section of the rings of each pair shall result in a thermal behaviour substantially identical to that of the fibres of the reinforcing rings 29a. In this variant, the ring 27 of largest external diameter is the first to be shrunk on the drum, followed, on each corrugation zone 25a, by the other rings 27, in the direction of decreasing diameters. It will be noted that in this embodiment the largest external diameter of the successive compression rings 27 is chosen to be less than the smallest internal diameter of the deformation locking ring 30 of the preceding pair, so as to allow successive engagements (shown by the arrows) of each ring 30 on its corresponding ring 27.

FIG. 15 illustrates an alternative embodiment applicable to the case of a drum possessing a single corrugation zone, in which the ring 27 possesses a double conical surface 31a, 31b. After the operation, of polymerising the resin with which the fibres of the reinforcing rings are impregnated, two Invar rings 30a and 30b, are engaged without play on the respective opposite faces of the ring 27. It will be noted that the rings 30a and 30b each have a respective conical surface 32a, 32b cooperating with the conical surfaces 31a and 31b, and each have a shoulder, 33a and 33b respectively.

In the drum obtained, it will be noted that during the cooling which follows the polymerisation operation, an equilibrium of the stresses is set up between the drum 25 and the fibres of the reinforcing rings 29. The compressive prestress which has been imposed on the drum has the effect of a slight tensile pull on the fibres of the binding rings. Even though the stresses imposed are very far from the breaking stresses, it will be noted that the axial symmetry of the drum allows uniform distribution of the loads. Under these conditions it is possible to indicate, by way of an order of magnitude, that the process of compressive prestressing of the drum results in a reduction of the diameter of the drum of the order of 0.2%. At the rated operating speed of rotation of the drum relaxation of the introduced prestress in the drum will result under the action of the centrifugal forces until an equilibrium is set up between the stresses imposed on the reinforcing fibres and those on the drum. Even at the rated rotational speed, the drum nevertheless remains under slight compressive prestress, which is an advantageous factor as regards the concentrations of stresses localised at the at the base of the blade seats, bearing in mind the fact that it is desirable to avoid subjecting a composite material to tensile stresses in directions transverse to the direction of the fibres.

Of course, without going outside the scope of the invention as defined in the following claims, various modifications can be introduced by those skilled in the art into the devices or processes which have just been described solely by way of non-limiting examples. Thus, for example, the process of manufacture according to the invention makes it possible to produce drums of conical shape.

We claim:

1. A drum for a compressor rotor having recess means for mounting rotor blades which comprises:

an internal layer of material;

an external layer of material;

a core layer of material sandwiched between said internal and external layers of material, said external layer of material being formed with peripheral ridges and grooves; and tensile reinforcing rings positioned within said grooves of said external layer of material.

2. The drum as defined in claim 1 wherein said recess means consist of orifices which are adapted to permit compressor blades to be positioned from within said drum, and which are disposed in said ridges of said external layer of material, said ridges having oblique faces.

3. The drum for a compressor rotor as defined in claim 1 wherein said internal and external layers of material are comprised of oriented layers of carbon fibres, said layers of fibres being oriented in a direction forming with the axis of said drum an angle equal to the angle formed by the root chord of the rotor blades with the axis of said drum, and wherein said layers of fibres are arranged to line the internal face of the moulding.

4. The drum for a compressor rotor as defined in claim 3 wherein said carbon fibres of said external layer of material are oriented at an angle $+\alpha$ parallel to the axis of said root chord of the rotor blades.

5. The drum for a compressor rotor as defined in claim 3 wherein successive layers of said carbon fibres of said internal layer of material are crossed, said fibres being oriented at an angle $+\alpha$.

6. The drum for a compressor rotor as defined in claim 1 wherein said grooves are filled with fibres of boron impregnated with a polymerised organic resin and with glass fibres impregnated with resin.

7. The drum for a compressor rotor as defined in claim 1 wherein a cone is mounted on a front face of said drum for connection to a compressor drive shaft.

8. The drum for a compressor rotor as defined in claim 7 wherein compressor blades are positioned in the recesses in the drum under a locking skirt for the blades, said locking skirt having at one end a flange fixed to the cone and at the other end, a flange fitted on the drum.

* * * * *